United States Patent [19]

White

[11] 4,215,265

[45] Jul. 29, 1980

[54] METHOD AND APPARATUS FOR PRODUCING CERAMIC WARE

[76] Inventor: Philip D. White, 286 Pleasant St., Marblehead, Mass. 01945

[21] Appl. No.: 860,476

[22] Filed: Dec. 14, 1977

Related U.S. Application Data

[63] Continuation-in-part of Ser. No. 740,800, Nov. 11, 1976, abandoned.

[51] Int. Cl.[2] ..... H05B 3/66

[52] U.S. Cl. ..... 219/390; 219/400; 432/23

[58] Field of Search ..... 219/390; 432/23, 199–202, 432/204, 157, 137, 136, 133, 13, 18; 13/31, 20, 22

[56] References Cited

U.S. PATENT DOCUMENTS

| | | | |
|---|---|---|---|
| 1,851,831 | 3/1932 | Hayes | 432/23 |
| 1,854,374 | 4/1932 | Hanson | 13/20 |
| 2,275,106 | 3/1942 | Hayes | 432/23 |
| 2,695,922 | 11/1954 | Matejka | 13/22 |
| 2,895,433 | 7/1959 | Michalis | 13/22 |
| 2,896,004 | 7/1959 | Duffy et al. | 13/22 |
| 2,963,529 | 12/1960 | Schmidt | 13/22 |
| 3,017,262 | 1/1962 | Fegan | 13/22 |
| 3,350,493 | 10/1967 | Randall | 13/22 |
| 3,469,947 | 9/1969 | Drury | 13/20 |
| 3,542,349 | 11/1970 | Ando et al. | 432/23 |
| 3,622,135 | 11/1971 | Roth et al. | 13/31 |
| 3,786,162 | 1/1974 | Colson | 219/390 |

*Primary Examiner*—B. A. Reynolds
*Assistant Examiner*—Bernard Roskoski
*Attorney, Agent, or Firm*—Kenway & Jenney

[57] ABSTRACT

An electric kiln for firing ceramic ware in a reducing atmosphere has a substantially sealed chamber with electrical-resistance heating elements. A compartment is provided within the kiln for selectively introducing a reducing agent into the chamber. According to the method, the temperature within the chamber is raised to a predetermined level by energizing the heating elements. Upon attainment of the desired temperature level, a selected quantity of the reducing agent is introduced into the chamber for producing a reducing atmosphere during the maturing of the ceramic ware. As the temperature is raised to a level at which the heating elements would be damaged, a substantially neutral atomsphere is maintained in the chamber. Aslo during cooling, a reducing atmosphere is possible for further reduction of the ware and glazes thereon.

6 Claims, 3 Drawing Figures

METHOD AND APPARATUS FOR PRODUCING CERAMIC WARE

CROSS-REFERENCE TO RELATED APPLICATIONS

This application is a continuation-in-part of my copending application Ser. No. 740,800, filed Nov. 11, 1976 now abandoned for Method and Apparatus Involving Ceramic Ware Production.

BACKGROUND OF THE INVENTION

The present invention relates to ceramic ware and, more particularly, is directed towards a method and apparatus involving the production of ceramic ware in a reducing atmosphere within an electrically heated kiln.

The process of producing ceramic ware involves the use of high temperatures. Kilns of various configurations have been used in the ceramic industry for firing of the ceramic ware, heat for such kilns being obtained from a variety of sources such as oil and gas combustion and electrical-resistance coils. The fuel fired kilns will, under the proper combustion conditions, naturally produce a reducing atmosphere in the kiln during the maturing process of ceramic ware production. The reducing atmosphere is, during some ceramic ware production steps, very advantageous.

The creation of a reducing atmosphere in an electrically heated kiln has met with limited success. Typically, the reducing atmosphere is introduced by burning small pieces of wood in the bottom of the kiln and the kiln is provided with an exhaust hole in the kiln top to allow exhaust gases and smoke and other particles to escape. In such kilns, however, the electrical-resistance heating elements, which are attacked by an active reduction atmosphere at temperatures about 2100° F., are coated with a protective oxide crust by subjecting the elements to a high temperature in an oxidizing atmosphere. Flame produced particles, introduced into the kiln chamber for providing a reducing atmosphere, have resulted in premature failure of the electrical-resistance heating elements by removing, fusing into or penetrating the protective crust. The burning wood also often produces large quantities of undesirable smoke and soot.

The heating element decay problem is further compounded by the requirement that when the kiln must be operated at high temperatures, often above 2100° F., active reduction must be continued to prevent reoxidation of the ware. This may further reduce the useful life of the heating elements.

One solution to this problem is the use of silicon carbide heating elements which are not susceptible to damage from a reduction atmosphere. However, while silicon carbide heating element type kilns do not have the element decay problem, they are much too costly for practical use by potters.

A principal object of the invention is therefore to provide an electrically heated kiln for ceramic ware production which does not suffer from the foregoing disadvantages.

Another object of the invention is to provide a method for producing a reducing atmosphere within an electrically heated kiln.

A further object of the invention is to provide a reliable, relatively low cost electrically heated kiln having the capability of providing a reducing atmosphere during the production of ceramic ware.

SUMMARY OF THE INVENTION

The kiln, according to the invention, features a substantially sealed chamber having electrical-resistance heating elements disposed therein for raising the temperature within the kiln to the desired level. The kiln is provided with a compartment for introducing a reducing agent into the chamber. The temperature within the kiln is raised to a level (below 2100° F. in the illustrated embodiment) by energizing the heating elements. This temperature level, which is selected by the operator depending upon the amount and type of reducing agent, the material used to make the clay and glaze, and the desired effects, permits reduction of the clay body of the ware including areas underneath the as yet unmelted glaze on the ware surface. (The upper temperature limit is determined by the particular heating element wire alloy used.) Upon attainment of the desired lower temperature, the reducing agent is introduced into the chamber on a body reduction pan composed of a high temperature stainless steel or suitable refractory material. The temperature is kept below 2050° F. for an appropriate film period to obtain the desired degree of body reduction. This reduction period is known as body reduction. When this has been accomplished, the pan, and reducing agent remaining therein, is withdrawn, and a neutral atmosphere will obtain in the kiln. The kiln is heated further to a temperature which may be above the noted upper limit, to obtain the maturing point of the clay and glazes. Upon attainment of the desired temperature level for maturing the ceramic ware, the heating elements are deenergized and the reducing agent may be reintroduced into the chamber after cooling down to a predetermined temperature. The reducing agent, if reintroduced in the kiln, produces a reducing atmosphere within the chamber for further reduction of the ceramic ware. This reduction state is sustained until the desired effects are obtained and the temperature may be held (by energizing the heating elements) to lengthen this reduction. Advantageously, by controlling the amount of reducing agent inserted during this step, a reducing and then reoxidizing atmosphere can occur in order to produce certain desirable glaze effects. Alternatively the kiln may be allowed to slowly cool naturally.

The invention accordingly comprises the apparatus and methods, together with their steps, parts, elements and interrelationships that are exemplified in the following disclosure, the scope of which will be indicated in the appended claims.

BRIEF DESCRIPTION OF THE DRAWINGS

A fuller understanding of the nature and objects of the present invention will become apparent upon consideration of the following detailed description taken in connection with the accompanying drawings, wherein.

DETAILED DESCRIPTION OF THE PREFERRED EMBODIMENTS

Figure 1:
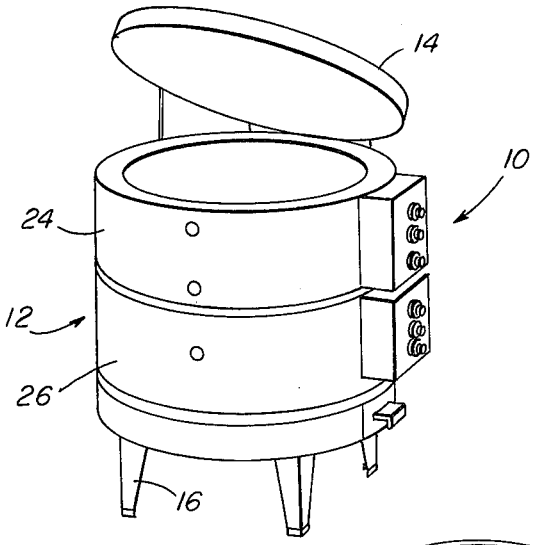
FIG. 1 is a perspective view of an electrically heated reducing kiln embodying the invention.
Figure 2:
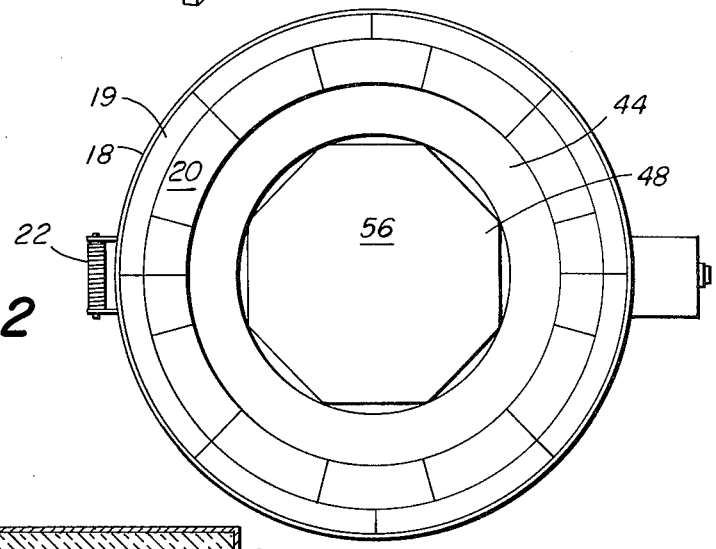
FIG. 2 is a top plan view of FIG. 1 with the cover removed.

Referring now to the drawings, particularly FIG. 1, there is shown an electrically heated, reducing kiln for producing ceramic ware. Kiln 10 is organized about a housing 12 having a hinged cover 14 and is supported by legs 16. Housing 12 includes an outer shell 18 composed of a metal such as stainless steel, an intermediate layer 19 composed of an insulating material, and an inner lining 20 composed of a material capable of withstanding high temperatures.

In the illustrated embodiment, lining 20 is an insulating firebrick lining and may be made from regular insulating firebrick or, preferably, from a cast firebrick material such as H.W. 2600 degree lightweight, insulating firebrick. Illustrated layer 19 is a castable block insulation of lightweight and highly insulating quality, and preferably is a castable vermiculite block sold under the tradename Kaiser Vee Block. A fastening device 22, for example, a spring loaded clamp or a bracket-bolt arrangement is provided for tightening outer shell 18. Alternatively and preferably, the outer shell is a single integral sheet of stainless steel.

Figure 3:
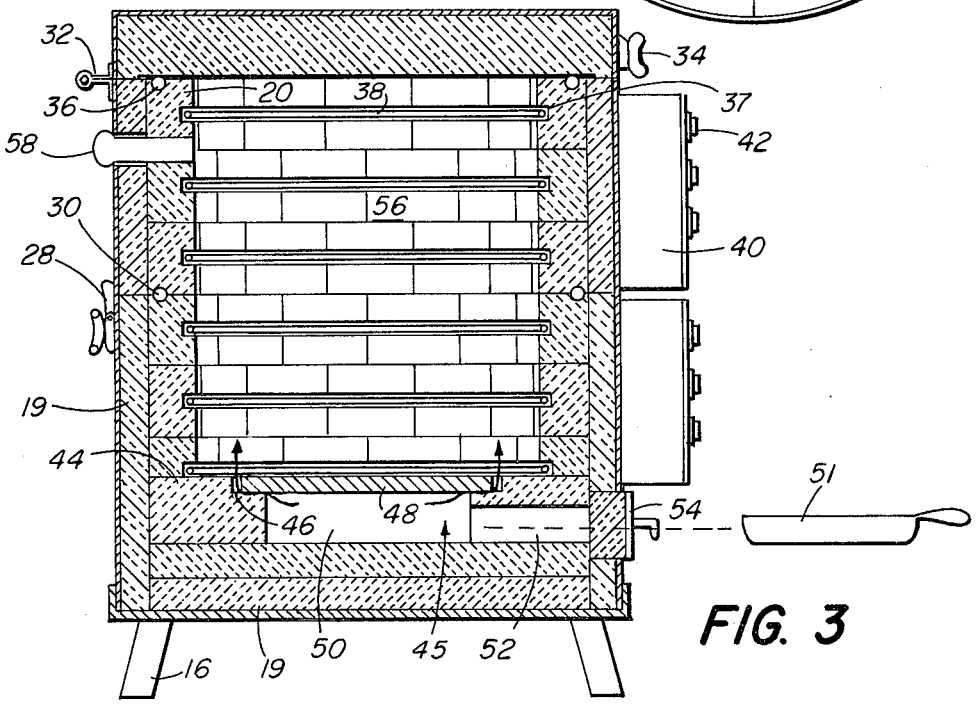
FIG. 3 is a sectional view of the electrically heated reducing kiln of FIG. 1.

In the illustrated embodiment, by way of example, housing 12 includes an upper section 24 and a lower section 26 that are secured together by means of a clamp 28. As best shown in FIG. 3., a seal 30 is provided between upper section 24 and lower section 26. In alternative embodiments, the number of sections comprising kiln 10 is other than two, for example, one, three, four, five, or more sections. It is to be understood that suitable seals are provided between sections of multi-section kilns. In alternate embodiments, wherein an integral shell is used, the sections 24, 26 may mechanically interlock against lateral movement.

Cover 14 is pivoted on a hinge 32 and held in its closed position by a clamp 34. A ring seal 36 is provided between an upper portion of inner lining 20 and cover 14. Lining 20 is preferably cast with notches or grooves 37 that are configured to receive heating elements 38 which are composed of a high electrical-resistance alloy consisting in the illustrated embodiment, essentially of Al 5.5%, Cr 22%, Co 0.5%, and the balance Fe. This material is sold commercially under the trade name Kanthal A-1. Preferably the grooves are at the joined ends of cast annulus ring sections 24, 26 and provide an enlarged inner portion to help restrain elements 38 in position.

Heating elements 38, which are wound from heavier gage wire than the average electric oxidation type kiln for increased life, are spring loaded so as to be snugly received within grooves 37. That is, heating elements 38 are in the form of resilient rings that are snapped into grooves 37, the rings expanding somewhat to seat firmly within the grooves. In the preferred embodiment, the size of wire used for heating elements 38 is in the range of 18 gauge to 8 gauge. Longest element service is obtained with elements wound from the heavier gauge material. Heating elements 38 are connected to controllers 40 which regulate the temperature within kiln 10. Controllers 40 are connected to a suitable power source (not shown). In the illustrated embodiment, the heat generated by each heating element 38 is controlled by an adjusting knob 42.

As best shown in FIG. 3, the bottom section of kiln 10 is provided with a floor 44 having an opened portion 45 central thereof. Floor 44 is formed with steps 46 at an interior edge of opening 45 on which a plate 48 rests, the opening being covered by the plate. In the preferred embodiment, plate 48 is composed of a refractory material which conducts and reradiates heat generated by heating elements 38. In one embodiment, plate 48 is composed of silicon carbide. A compartment 50, which is located below plate 48 and a portion of floor 44, is accessible at an exterior wall of kiln 10 through a stoking port 52. Compartment 50 is configured to receive a reducing agent such as charcoal for producing a reducing atmosphere within kiln 10. A door 54 is provided for sealing, in the preferred embodiment, compartment 50 from gaseous communication with the atmosphere exterior to the kiln. With door 54 and cover 14 in their closed position, as shown in FIG. 3., a substantially air tight chamber 56 is formed in the interior of kiln 10. The chamber may, however, be "leaky" to allow the sealing members previously described to operate as one-way valves which would then prevent exterior air from entering into chamber 56 during firing of the ceramic ware. Preferably, however, the chamber is slightly "leaky" in both directions so that a pressure barrier, which builds up within the kiln as it generates reducing gases, prevents an oxidizing atmosphere from entering the kiln chamber or rapid atmosphere exchange. Plate 48 is seated on steps 46 in such a manner that a carbonaceous gas produced within compartment 50 flows around plate 48 and into chamber 56 as indicated by arrows 60. The naturally "rough" finish of step 46 and/or plate 48 provides that necessary gaseous communication between compartment 50 and chamber 56, while preventing fly ash and other solid particles from rising into the upper chamber 56.

In a typical production sequence for producing ceramic ware using kiln 10, heating elements 38 are energized until the temperature within chamber 56 reaches at least 1950° F. This temperature level is maintained for several hours in an oxidizing atmosphere within chamber 56 in order to form a protective coating or oxide crust on heating elements 38, for example, Kanthal type A-1 heating elements. Preheating of the Kanthal heating elements in an oxidizing atmosphere results in the formation of an oxide coating thereon which helps protect the elements at high temperature levels of 2000° F. and above. The protective coating resists premature deterioration and failure of heating elements 38 which results from exposure of the heating elements to a reducing atmosphere. Since reduction firing for maturing of the ceramic ware gradually destroys this protective covering or crust, the heating elements are exposed to the 1950° F. oxidizing atmosphere at periodic intervals for restoration of the protective coating.

Upon completion of the heater coating process, ceramic ware to be fired is placed on suitable shelves or holders within chamber 56. Cover 14 is locked and door 54 is closed in order to make chamber 56 substantially air tight. The heating elements are energized until the temperature within chamber 56 reaches a predetermined minimum level (approximately 1350° F.) which is sufficient for reducing the ceramic ware. Upon attainment of this temperature, the reducing agent is introduced into the chamber on a body reduction pan 51 composed of a high temperature stainless steel, for example, and the temperature is held at a level below 2100° F. for an appropriate time period to obtain the desired degree of body reduction. By the end of the body reduction stage, the temperature within the kiln should preferably be at or just below 2100° F. by appropriately energizing the heating elements. This temperature level permits reduction of the clay body of the ware including areas underneath the as yet unmelted glaze on the ware surface. When the required reduction has been accomplished, the pan and reducing agent remaining therein (if any) is withdrawn and the kiln is heated further to obtain the maturity point of the clay and glazes.

In one particular embodiment of the invention, one or more pyrometric cones are placed within chamber 56. These cones, which are rated for different temperatures ranging from 1100° F. to 3600° F., are used to follow the temperature rise and to determine the maturing point of the ceramic ware being fired in kiln 10. The softening and deformation of a selected cone, which is observed through a sight hole 58 in kiln 10, indicates attainment of the desired heat/maturity level. For the particular temperature range of 1600° F. to 2500° F., one or more pyrometric cones are placed within chamber 56. In alternative embodiments, the temperature level in kiln 10 is controlled by a thermostat or pyrometer connected to a suitable feedback system for temperature regulation. Upon attainment of the desired maturity temperature level, heating elements 38 are deenergized and chamber 56 is allowed to cool to a temperature level of approximately 2200° F., at which temperature a reducing atmosphere can be reintroduced into the chamber without unduly shortening the life of the heating elements. After the second reducing step, the kiln is allowed to cool and the fired ceramic ware is removed.

In the preferred embodiment, the reducing agent is a carbon material. It has been found that reduction is more uniform and easily controlled by using a reducing agent of a consistent, measurable size. Thus, in the preferred embodiment, the reducing agent is charcoal briquettes. As noted above, the carbonaceous material is placed within the compartment 50 via door 54.

The temperature level within chamber 56 during the reducing phase of the process is sufficiently high to generate a carbonaceous gas from the briquettes. That is, the heat within the chamber is sufficiently high to cause vaporization of the charcoal briquettes and the production of the carbonaceous gas. The carbonaceous gas preferably consists of primarily carbon monoxide free carbon, and other hot carbon forms that have not stabily combined with oxygen. These hot gases circulate within the chamber 56 through, for example natural convection or by forced circulation (for example, using a fan), to provide a substantially uniform reducing atmosphere. Preferably the structure of the kiln promotes adequate convection circulation. The hot gases combine with oxygen from the ware and surfaces of the kiln to "create reduction." Carbon dioxide does not do this; it is substantially neutral.

The quantity and rate at which the charcoal is introduced into compartment 50 governs the degree of reduction atmosphere attained. The carbonaceous gas seeps upwardly around plate 48 into chamber 56 and produces the reducing atmosphere within the chamber. Plate 48 also prevents fly ash or solid particles from rising into the upper chamber 56 and possibly settling on a heating coil where it might melt and cause element failure. As previously indicated, the substantial sealing of chamber 56 provides a controlled reducing atmosphere and minimizes charcoal atmosphere from leaking out of the chamber. Upon completion of the process step requiring a reducing atmosphere, the reducing agent is removed from the kiln and the ware is matured as noted above.

From the foregoing description, it will be appreciated that the present invention provides an electrically heated reducing kiln for firing ceramic ware. The method of the invention includes the steps of heating the ceramic ware in a reducing atmosphere in a substantially sealed chamber of an electric kiln, raising the temperature within the sealed chamber of the electrically heated kiln to a predetermined level at which the ceramic ware matures in a substantially neutral atmosphere which preserves element life, dropping the temperature within the chamber to a selected temperature, producing a reducing atmosphere within the sealed chamber by reintroducing a reducing agent within a compartment that communicates with the sealed chamber, and allowing the chamber to cool. The method further features, in one aspect, the step of periodically subjecting the heating elements to a high temperature in an oxidizing atmosphere for producing a protective coating on the heating elements.

Since certain changes may be made in the foregoing disclosure without departing from the scope of the invention herein involved, it is intended that all matter contained in the above description and depicted in the accompanying drawings be construed in an illustrative and not in a limiting sense. Thus additions, subtractions, deletions and modifications of the described preferred embodiment would be obvious to one skilled in the art and are within the scope of the following claims.

What is claimed is:

1. A reducing kiln for producing ceramic ware, said kiln comprising:

(a) a housing having
- an interior, at least substantially sealable, chamber for receiving ceramic wire;
- an opening in said chamber for introducing ceramic ware into said chamber;
- a cover for said opening;
- an inner refractory lining;
- a floor formed with a second opening; and
- a plate member mounted on said floor and covering said opening;

(b) a compartment accessible from an exterior wall of said housing through a closeable access opening and communicating with said sealable chamber, said compartment configured to receive a reducing agent, at least a portion of said compartment being disposed below said plate, and said plate and said floor cooperating to prevent solid particulate from entering said chamber from said compartment;

(c) said plate member and said floor further cooperating to allow gas to seep from said compartment to said chamber for providing a substantially uniform gaseous environment in said chamber;

(d) electrical heating wire elements mounted to said housing within said chamber, said heating wire elements being subject to damage in a reduction atmosphere, and exposed to a central portion of said chamber, said electrical heating elements having an energized and a deenergized state, said chamber being heated when said electrical heating elements are energized;

(e) control means for controlling the state of said electrical heating elements; and (f) means operatively connected to said heating elements and said control means for supplying power to said heating elements.

2. The reducing kiln as claimed in claim 1 wherein said housing has an outer shell and said electrical heating means is mounted to said inner lining.

3. The reducing kiln as claimed in claim 2 wherein said inner lining is firebrick, said electrical heating means being resilient rings that are mounted within notches formed in said firebrick.

4. The reducing kiln as claimed in claim 1 wherein said reducing agent is composed of a solid material that emits a carbonaceous gas for producing a reducing atmosphere within said chamber.

5. The reducing kiln as claimed in claim 1 wherein said electrical heating means is electrical-resistance heating elements consisting essentially of Al 5.5%, Cr 22%, Co 0.5%, and the balance Fe.

6. The reducing kiln as claimed in claim 1 wherein said electrical-resistance heating elements are in the form of resilient rings, said housing has a plurality of cast firebrick annuli forming the inner lining notches and said heating elements are sungly received in notches formed in the inside lining surface where two annuli join.

* * * * *

UNITED STATES PATENT AND TRADEMARK OFFICE

CERTIFICATE OF CORRECTION

PATENT NO. : 4,215,265

DATED : July 29, 1980

INVENTOR(S) : Philip D. White

It is certified that error appears in the above-identified patent and that said Letters Patent are hereby corrected as shown below:

In the specification:

Abstract, last sentence, "Aslo" should read --Also--.

Col. 1, line 38, "about" should read --above--.

Col. 2, line 26, "film" should read --time--.

Col. 4, line 30, "that" should read --the--.

In the claims:

Claim 1, col. 6, line 36, "wire" should read --ware--.

Signed and Sealed this

Sixteenth Day of June 1981

[SEAL]

Attest:

RENE D. TEGTMEYER

Attesting Officer

Acting Commissioner of Patents and Trademarks